US008558519B2

(12) United States Patent
Bryant et al.

(10) Patent No.: US 8,558,519 B2
(45) Date of Patent: Oct. 15, 2013

(54) APPARATUS AND METHOD FOR REVERSE POWER REGULATION WITH MEASURED SOURCE SIDE VOLTAGE

(75) Inventors: Timothy J. Bryant, Palm Harbor, FL (US); Thaichong Li, Palm Harbor, FL (US)

(73) Assignee: Beckwith Electric Co., Inc., Largo, FL (US)

( * ) Notice: Subject to any disclaimer, the term of this patent is extended or adjusted under 35 U.S.C. 154(b) by 367 days.

(21) Appl. No.: 12/544,078

(22) Filed: Aug. 19, 2009

(65) Prior Publication Data

US 2010/0045246 A1 Feb. 25, 2010

Related U.S. Application Data

(60) Provisional application No. 61/089,985, filed on Aug. 19, 2008.

(51) Int. Cl.
*G05F 1/14* (2006.01)

(52) U.S. Cl.
USPC ..... 323/255; 323/301; 323/342; 323/359

(58) Field of Classification Search
USPC ..... 323/255, 257, 258, 340, 342, 359, 301
See application file for complete search history.

(56) References Cited

U.S. PATENT DOCUMENTS 4,419,619 A * 12/1983 Jindrick et al. ..... 323/257
4,834,816 A * 5/1989 Hasegawa et al. ..... 148/304
5,461,300 A * 10/1995 Kappenman ..... 323/215
5,581,173 A 12/1996 Yalla et al.
5,646,512 A * 7/1997 Beckwith ..... 323/257
5,670,864 A * 9/1997 Marx et al. ..... 323/211
6,313,614 B1 * 11/2001 Persson et al. ..... 323/255
6,486,641 B2 * 11/2002 Scoggins et al. ..... 323/257
6,680,602 B2 * 1/2004 Iyoda et al. ..... 323/207
2005/0068013 A1 * 3/2005 Scoggins ..... 323/258
2005/0104567 A1 * 5/2005 Beckwith ..... 323/258
2007/0222421 A1 * 9/2007 Labuschagne ..... 323/255

OTHER PUBLICATIONS

Digital Voltage Regulator Control M-6200A—Digital Regulator Control for General Electric, Siemens, Cooper and Howard Regulators (2006). Beckwith Electric Co. Retrieved from http://www.beckwithelectric.com/docs/specs/M-6200A-Sp-00_(01-10).pdf on Apr. 18, 2011.*
M-6200 Digital Regulator Control Instruction Book.
Digital Regulator Control M-6200—Digital Regular Control for General Electric, Siemens, Cooper and Howard Regulators.
M-6200 Digital Regulator Control Instruction Book, 2008.
Digital Regulator Control M-6200—Digital Regular Control for General Electric, Siemens, Cooper and Howard Regulators, 2008.

* cited by examiner

*Primary Examiner* — Adolf Berhane
*Assistant Examiner* — Fred E Finch, III
(74) *Attorney, Agent, or Firm* — Gray Robinson, P.A.

(57) ABSTRACT

An apparatus and method for measuring the source-side line voltage from a source potential transformer (PT) of a regulator during reverse power flow. A reverse power regulation algorithm is employed during reverse power operation of the tapchanger to energize a contact relay which switches the analog voltage input from the load side to the source side of the regulator. Voltage regulation then operates based on the measured source side voltage instead of the traditional calculation of the source side voltage based upon the load-side voltage and regulator type.

21 Claims, 3 Drawing Sheets

APPARATUS AND METHOD FOR REVERSE POWER REGULATION WITH MEASURED SOURCE SIDE VOLTAGE

CROSS-REFERENCE TO RELATED APPLICATIONS

This application claims the benefit of provisional application No. 61/089,985, filed Aug. 19, 2008, the disclosure of which is hereby incorporated by reference herein.

BACKGROUND OF THE INVENTION

1. Field of the Invention

This invention relates to tapchangers employed in electrical power distribution systems to maintain voltage levels of electrical power lines within predetermined ranges. More particularly, this invention provides an apparatus and method for transferring, upon detection of reverse power flow, the tapchanger control voltage input from the forward power load side to the reverse power load side of the tapchanger.

2. Description of the Background Art

In electrical power distribution systems, voltage levels on a power line tend to vary due to several factors such as the load on the power line and the power line's impedance. In order to maintain the voltage level on a power line within a predefined range or bandwidth of a fixed voltage level (e.g., 120 volts), regulators, such as load tapchanging (LTC) transformers or series regulating auto transformers using motor-driven tapchanger switches, are employed to incrementally increase or decrease the power line voltage.

Typically, tapped auto transformers comprise a tapped series winding that is operatively connected to a shunt winding by means of a tapchanging motor that rotates in either an incrementing or decrementing direction depending upon whether the regulator is used to incrementally "boost" (increase) or "buck" (decrease) the load voltage. Controllers, such as that disclosed in U.S. Pat. No. 5,581,173, the disclosure of which is hereby incorporated by reference herein, are employed to monitor the line voltage during forward power flow and, as the line voltage decreases or increases outside the predefined bandwidth, to then energize the tapchanger motor to incrementally boost or buck the line voltage to maintain the power line voltage within the predefined bandwidth of a fixed voltage level.

Due to power line topologies, forward power flow through a transformer may reverse direction. Consequently, the tapchanger must therefore operate during reverse power flow in order to properly boost or buck line voltage during such reverse power flow. Prior art tapchangers have typically calculated the source voltage according to the actual tap position and the type of regulator being used (e.g., Type A non-inverted configuration or Type B inverted configuration). Unfortunately, however, merely calculating the source voltage leads to inaccuracies in tapchanging during reverse power flow.

Therefore, it is an object of this invention to provide an improvement which overcomes the aforementioned inadequacies of the prior art tapchanger controllers and provides an improvement which is a significant contribution to the advancement of the tapchanger controller art Another object of this invention is to provide an apparatus and method for increasing the accuracies of tapchanger controllers during reverse power flow.

Another object of this invention is to provide an apparatus and method for measuring the source side voltage during reverse power flow to assure more accurate tapchanging during reverse power flow.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an apparatus and method for measuring the source-side line voltage of a regulator during reverse power flow. The regulator is provided with a source potential transformer (PT). The tapchanger controller includes a source PT input from which the source-side line voltage may be measured (in lieu of prior art methods of simply calculating the source voltage based upon the measurement of the load PT and summing it with the voltage drop calculated across the tapchanger winding). By using the measured source line voltage, more accurate control of the tapchanger may be achieved.

More particularly, a reverse power regulation algorithm ("Source Side PT") is employed during reverse power operation of the tapchanger to energize a contact relay which switches the analog voltage input from the load side to the source side of the regulator. Voltage regulation then operates based on the measured source side voltage instead of the traditional calculation of the source side voltage based upon the load-side voltage and regulator type.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
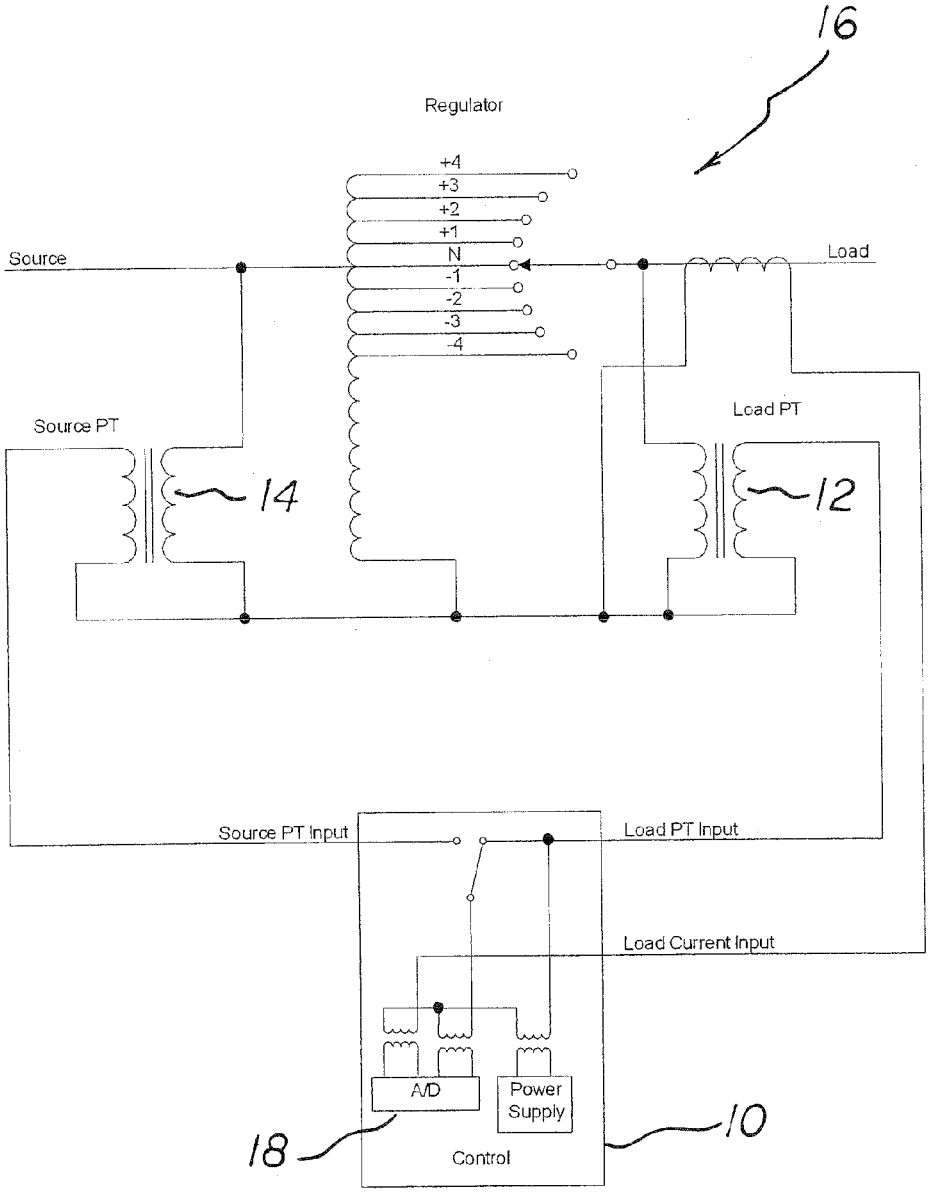
FIG. 1 is a schematic diagram of a regulator having a source PT installed therein from which the controller of the invention measures the source-side voltage to control the voltage during reverse power flow.

The commercial implementation of the present invention is known in the industry as the "Beckwith M-6200 Digital Regulator Control" and is described in its Instruction Book and its Specifications and Application Guide (originally appended to the provisional application 61/089,985, filed Aug. 19, 2008, the disclosures of each of which are hereby incorporated by reference herein). Further, this detailed discussion of the preferred embodiment focuses on the present invention's software that is intended to be implemented on a microcomputer similar to those disclosed in the aforementioned publications and in corresponding U.S. Pat. No. 5,581,173, the disclosure of which is hereby incorporated by reference herein As shown in FIG. 1, the controller 10 of the present invention employs a load-side PT 12 providing a load-side line voltage and a source-side PT 14 providing a source-side line voltage to the regulator 16. The controller 10 includes a reverse-power detector 18 that measures the real component of the load current in the power line to detect reverse power flow in the power line.

Detector 18 detects reverse power whenever the real component of the line current changes direction from forward and remains until another reversal to forward power flow occurs. The detector 18 preferably determines power direction with as little as 2% of the real component of the nominal 200 mA line current (4.0 mA). An LED may be provided on the front panel of controller 10 to indicate whenever the controller 10 senses a reverse power condition.

An input screen may be provided allowing a user to select power direction bias setpoints. Preferably, the screen provides three settings allowing the user to determine how the controller 10 will switch between forward and reverse power operation. For example, the three settings may comprise "None", "Forward Bias", and "Reverse Bias".

In this preferred embodiment, when the power direction bias function is set to "None", the controller 10 applies an 8 mA hysteresis band with a bandcenter of 0 load current (+4 mA to −4 mA) to switch between forward and reverse power. The controller 10 will switch from forward power to reverse power when the load current exceeds −4 mA (reverse direction). The controller 10 will switch from reverse power to forward power when the load current exceeds +4 mA (forward direction).

When the power direction bias function is set to "Forward Bias", the controller 10 applies a 0 mA to −4 mA hysteresis band to switch between forward and reverse power. The controller 10 will switch from reverse power to forward power when load current is >0 mA (forward direction). The controller 10 will switch from forward power to reverse power when the load current exceeds −4 mA (reverse direction).

When the power direction bias function is set to "Reverse Bias", the controller 10 applies a 0 mA to +4 mA hysteresis band to switch between forward and reverse power. The controller 10 will switch from forward power to reverse power when load current is <0 mA (reverse direction). The control will switch from reverse power to forward power when the load current exceeds +4 mA (forward direction).

Figure 2:
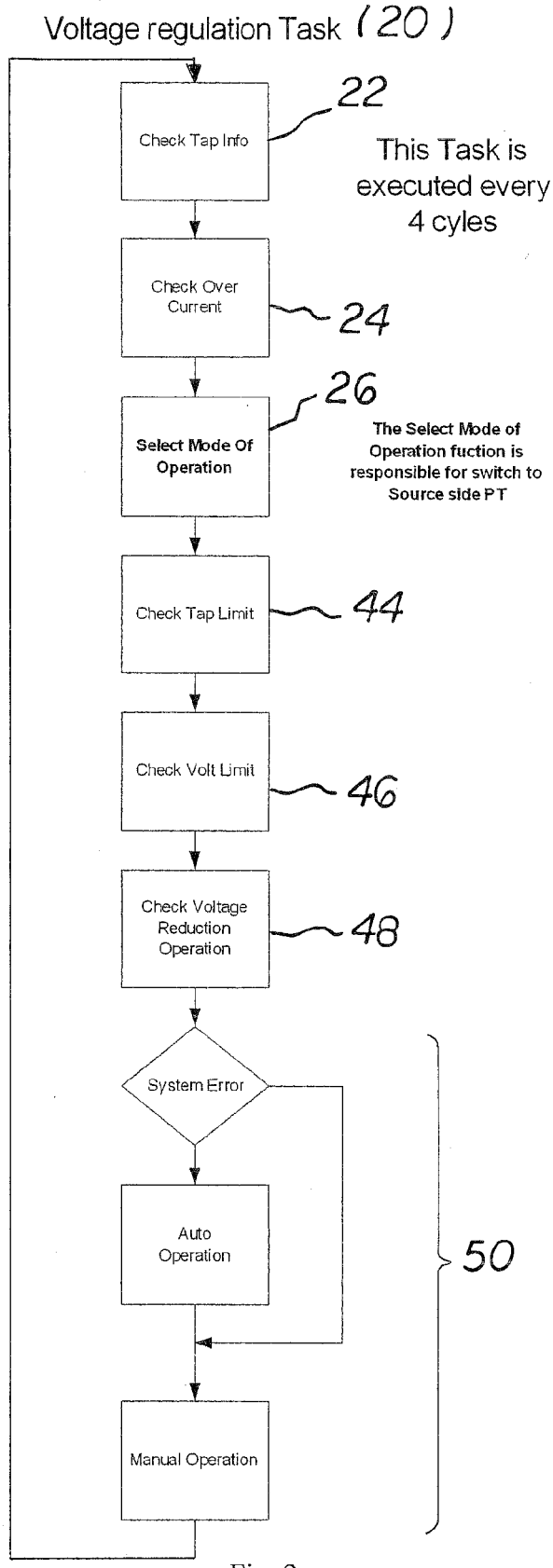
FIG. 2 is a software flow diagram of the Voltage Regulation Task that is executed under software control.

As shown in FIG. 2, under software control, a Voltage Regulation Task 20 is cyclically executed (e.g., every 4 cycles.). After checking the tap information 22, over-current is checked 24. Then, program control transfers to the Mode of Operation Task 26 (shown in FIG. 3).

Figure 3:
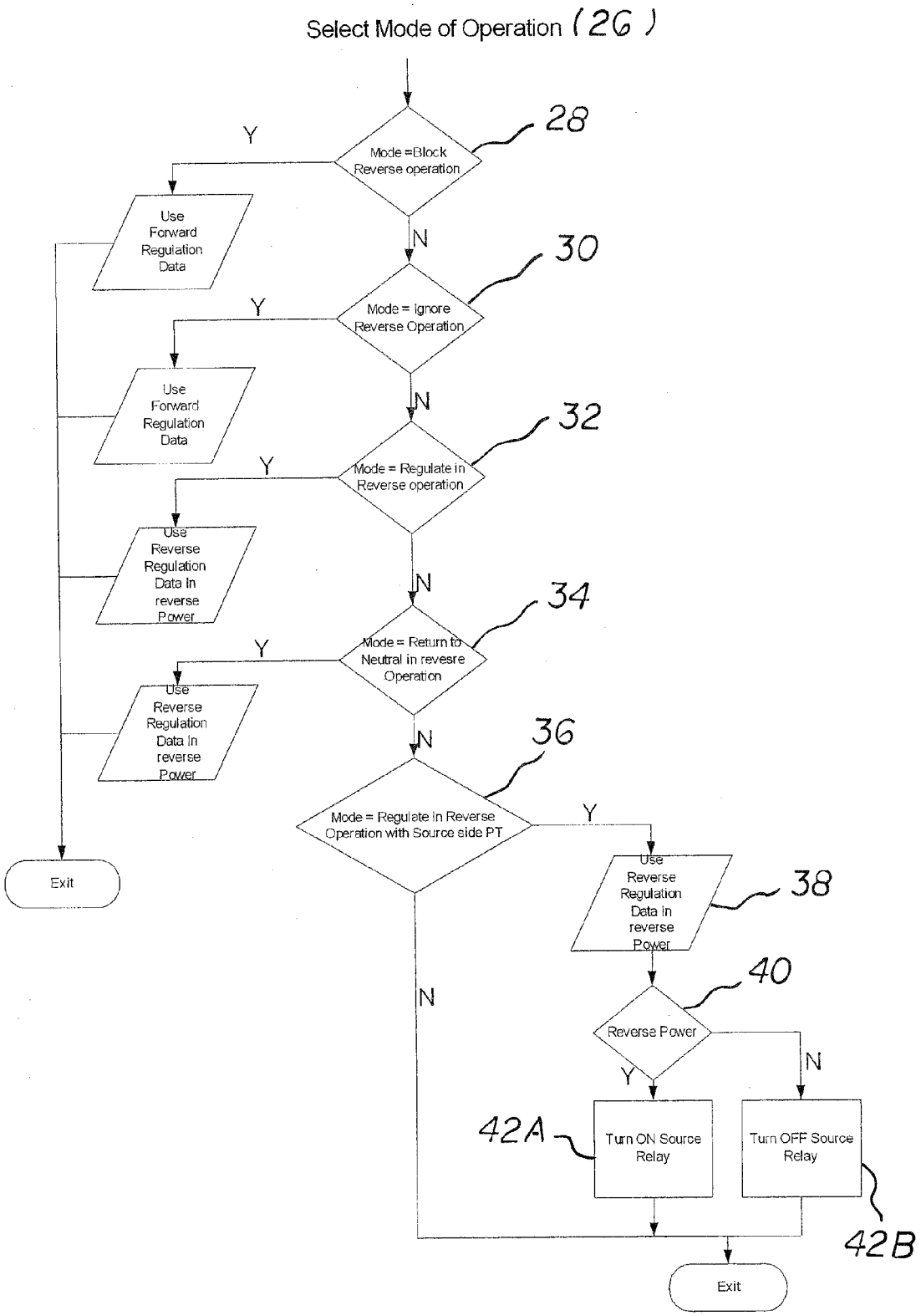
FIG. 3 is a software flow diagram of the Mode of Operation Task that is executed under software control.

As shown in FIG. 3, when the program control executes the Mode of Operation Task 26, user-controlled modes are queried, preferably "Block" 28, "Ignore" 30, "Regulate in Reverse Operation" 32, "Return to Neutral" 34 and "Regulate in Reverse Direction" 36.

Specifically, Block 28 inhibits automatic tapchange operation. This locks the tapchanger on the tap position in use at the time reverse power flow is detected. It is the recommended setting for independent power producers or in situations when reverse power flow is not expected. The controller 10 will revert to normal operation when forward power flow resumes.

Ignore 30 will not take any different action than in the forward direction. It essentially does not use the power direction in the control decisions. This is the same as a control which does not have power direction knowledge. This mode is intended for use on distribution systems which have the possibility of power reversal because of distributed generation (DG) on the feeders. In these applications, the DG usually does not have the capacity to control the voltage with the more powerful system intact. The condition required for DG to control the voltage is the generation and transmission of large amounts of VArs through the line impedance back towards the system source. Usually two items prohibit this action: 1) the ability of the DG to generate those amounts of VArs and 2) the contractual obligations enforced by many utilities that the DG only affect KWs on the system.

Regulate in Reverse Operation (Regulate REV) 32 is intended for single-phase regulators only. The controller 10 will detect reverse power flow and regulate according to reverse power settings as selected in the Setpoint Menu described above. With tap position knowledge, the controller 10 calculates the source-side potential without the use of a source side PT. This feature is designed for use with feeder voltage regulators which continue to operate in a radial mode after system switching causes the power flow reversal. The source voltage is calculated by knowing the local voltage, the load current, and the tap position using a presumed regulator impedance. That impedance is a function of the tap position. The calculated source voltage is only valid with a ⅝% step-voltage regulator. In this mode, when the controller 10 recognizes reverse power flow, the following occurs:

A REV PWR LED is illuminated.

Reverse power setpoints are used.

Source voltage is calculated and motor output commands are reversed.

For example, when the voltage is high, the control raises the tap thereby lowering the voltage and a lower is indicated on the front panel LEDs.

In Return to Neutral 34 mode, a counter input or motor hold input must be provided, and keep track tap information modes must be enabled. The Return to Neutral mode will cause the tap position to be driven to neutral when reverse power is detected. Tap position will be driven to neutral regardless of the voltage or currents present at the controller 10. Once neutral is reached, the tap position will remain unchanged as long as reverse power is present. Normal operation will resume when forward power is detected. This mode is intended as a safe response to a power reversal on a system which can have conflicting situations. As described earlier, a radially operating system with reverse power should be set to "Regulate Measured Rev." However, if a DG causes a power reversal, the preferred mode is usually "Ignore". In an application where both conditions are possible and it is not possible for the controller 10 to determine the cause of power reversal, the preferred mode is "Return to Neutral".

It should be appreciated from the foregoing that if the user either chose to block reverse mode operation or chose to ignore reverse operation, only the forward regulation data is used. Conversely, if the user either chose to regulate in reverse operation or to return-to-neutral during reverse operation, the reverse regulation data in reverse power is used. Further, if upon being queried, the user chose any one of the four modes, the Mode of Operation Task exits and program control returns to the Voltage Regulation Task (FIG. 2).

If the user did not choose any of the above four modes and instead chose to regulate in reverse operation with source side PT 36, program control does not exit. Rather, program control, using the reverse regulation data in reverse power 38, then determines if reverse power exists 40. If no, the Source Relay is turned off 42B (resulting in use of load voltage) whereas if yes, the Source Relay is turned on 42A (resulting in use of source voltage). Program control then returns to the Voltage Regulation Task (FIG. 2).

Returning to FIG. 2, once program control returns from the Mode of Operation Task of FIG. 3 to the Voltage Regulation Task of FIG. 2, the tap limit 44, voltage limit 46 and voltage reduction operation 48 are checked. Then, 50, the system is checked and any indicated error(s) are generated to bypass automatic operation. Then, if necessary, manual operation mode is executed.

As noted above, the measured source side voltage is measured from the source-side PT. The magnitude of the source side voltage is then calculated, preferably by using a Recursive Discrete Fourier Transform, following the equation below.

$$Ar(k) = \frac{2}{64}\sum_{n=0}^{63} x(n)\cos\left(k\frac{2\pi}{64}n\right) \quad k = 1, 2, \ldots 31$$

$$Ai(k) = \frac{2}{64}\sum_{n=0}^{63} x(n)\sin\left(k\frac{2\pi}{64}n\right) \quad k = 1, 2, \ldots 31$$

The first harmonic Magnitude will then be when k=1; $Vs^2=Ar(1)^2+Ai(1)^2$

Note that the voltage signal is preferably continuously being sampled at a rate of 3840 samples per sec. With the Voltage Regulation Task being executed every 4 cycles, the sampling is 4*16.666-66.666 milliseconds. Note also that the Reverse Power detection preferably has a latency of 5 seconds to avoid flickering between forward and reverse operation.

The following are preferred setpoints according to the best mode of operation of the invention:

Source CT/VT phasing.

Range: 0 to 330 degrees in increments of 30 degrees.

Source VT Multiplier.

Range: 0.1 to 3260 in increment of 0.1

Source VT Correction.

Range: −15 to 15 volts in increment of 0.1 volt.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for reverse power regulation with measured source side voltage comprising, in combination:

a regulator for a power line, said regulator including a load potential transformer (PT) providing a load-side line voltage and a source PT providing a source-side line voltage;

a controller including a load PT input operatively connected to said load PT providing analog load-side line voltage and a source PT input operatively connected to said source PT providing source-side line voltage; and said controller comprising a reverse-power detector that measures the real component of the current in the power line to detect reverse power flow in the power line and, upon reverse power flow, executes a reverse power regulation algorithm to provide voltage regulation based upon source-side line voltage; and said controller executes a user-selectable ignore reverse algorithm to ignore reverse operation, whereupon the controller provides voltage regulation based upon load-side line voltage.

2. The apparatus as set forth in claim 1, wherein said regulator comprises a single-phase regulator and wherein said controller executes a user-selectable Regulate REV algorithm to calculate source-side voltage and provide voltage regulation based upon the calculated source-side voltage.

3. The apparatus as set forth in claim 1, wherein said controller executes a hysteresis algorithm upon detection of reverse power.

4. The apparatus as set forth in claim 3, wherein said hysteresis algorithm causes the reverse power regulation algorithm to provide voltage regulation based upon source-side line voltage when power flow reverses to a preset amount.

5. The apparatus as set forth in claim 3, wherein said hysteresis algorithm causes a forward power regulation algorithm to provide voltage regulation based upon load-side line voltage when power flow returns to a forward power flow by a preset amount.

6. The apparatus as set forth in claim 5, wherein said preset amounts are user-selectable to different amounts thereby biasing voltage regulation in either the forward power or reverse power directions.

7. The apparatus as set forth in claim 1, wherein a magnitude of the source side voltage (Vs) is calculated by using a Recursive Discrete Fourier Transform.

8. The apparatus as set forth in claim 7, wherein said Recursive Discrete Fourier Transform comprises, $$Ar(k) = \frac{2}{64}\sum_{n=0}^{63} x(n)\cos\left(k\frac{2\pi}{64}n\right) \quad k = 1, 2, \ldots 31$$

$$Ai(k) = \frac{2}{64}\sum_{n=0}^{63} x(n)\sin\left(k\frac{2\pi}{64}n\right) \quad k = 1, 2, \ldots 31$$

with the first harmonic Magnitude being when k=1; $Vs^2=Ar(1)^2+Ai(1)^2$, for all possible functions of n.

9. The apparatus as set forth in claim 1, wherein said reverse power regulation algorithm comprises a latency to minimize flickering between forward and reverse power operation.

10. An apparatus for reverse power regulation with measured source side voltage comprising, in combination:

a regulator for a power line, said regulator including a load potential transformer (PT) providing a load-side line voltage and a source PT providing a source-side line voltage;

a controller including a load PT input operatively connected to said load PT providing analog load-side line voltage and a source PT input operatively connected to said source PT providing source-side line voltage; and said controller comprising a reverse-power detector that measures the real component of the current in the power line to detect reverse power flow in the power line and, upon reverse power flow, executes a reverse power regulation algorithm to provide voltage regulation based upon source-side line voltage; and said controller executes a user-selectable block reverse algorithm to block reverse operation, whereupon the controller ceases providing voltage regulation during reverse power.

11. An apparatus for reverse power regulation with measured source side voltage comprising, in combination:

a regulator for a power line, said regulator including a load potential transformer (PT) providing a load-side line voltage and a source PT providing a source-side line voltage;

a controller including a load PT input operatively connected to said load PT providing analog load-side line voltage and a source PT input operatively connected to said source PT providing source-side line voltage; and said controller comprising a reverse-power detector that measures the real component of the current in the power line to detect reverse power flow in the power line and, upon reverse power flow, executes a reverse power regulation algorithm to provide voltage regulation based upon source-side line voltage; and said controller executes a user-selectable return-to-neutral algorithm to return a regulator's tap position to neutral when reverse power is detected.

12. A method for reverse power regulation with measured source side voltage comprising the steps of:

measuring a load-side line voltage and a source-side line voltage of a regulator of a power line;

measuring the real component of the current in the power line to detect reverse power flow in the power line;

upon reverse power flow, providing voltage regulation based upon source-side line voltage; and obtaining user input to ignore reverse operation whereupon the step of providing voltage regulation is then based upon load-side line voltage.

13. The method as set forth in claim 12, further comprises the step of keeping track of the tap position of a tapchanger and the step of calculating the source-side voltage and providing voltage regulation based upon the calculated source-side voltage.

14. The method as set forth in claim 12, wherein said step of providing voltage regulation based upon source-side line voltage upon detection of reverse power occurs when power flow reverses to a preset amount.

15. The method as set forth in claim 14, further comprising the step of providing voltage regulation based upon load-side line voltage when power flow returns to a forward power flow by a preset amount.

16. The method as set forth in claim 15, further comprises the step of user-selecting said preset amounts to different amounts thereby biasing voltage regulation in either the forward power or reverse power directions.

17. The method as set forth in claim 12, further comprises the step of calculating a magnitude of the source side voltage (Vs) using a Recursive Discrete Fourier Transform.

18. The method as set forth in claim 17, wherein said Recursive Discrete Fourier Transform comprises $$Ar(k) = \frac{2}{64}\sum_{n=0}^{63} x(n)\cos\left(k\frac{2\pi}{64}n\right) \quad k = 1, 2, \ldots 31$$

$$Ai(k) = \frac{2}{64}\sum_{n=0}^{63} x(n)\sin\left(k\frac{2\pi}{64}n\right) \quad k = 1, 2, \ldots 31$$

with the first harmonic Magnitude being when k=1; $Vs^{2=}Ar(1)^2+Ai(1)^2$, for all possible functions of n.

19. The method as set forth in claim 12, further comprises the step of providing voltage regulation based upon source-side line voltage upon reverse power flow comprises minimizing flickering between forward and reverse power operation.

20. A method for reverse power regulation with measured source side voltage comprising the steps of:

measuring a load-side line voltage and a source-side line voltage of a regulator of a power line;

measuring the real component of the current in the power line to detect reverse power flow in the power line;

upon reverse power flow, providing voltage regulation based upon source-side line voltage; and obtaining user input to block reverse operation, whereupon the step of providing voltage regulation ceases during reverse power.

21. A method for reverse power regulation with measured source side voltage comprising the steps of:

measuring a load-side line voltage and a source-side line voltage of a regulator of a power line;

measuring the real component of the current in the power line to detect reverse power flow in the power line;

upon reverse power flow, providing voltage regulation based upon source-side line voltage; and keeping track of the tap position of a tapchanger and returning the tap position to neutral when reverse power is detected.

* * * * *